US008790001B2

(12) United States Patent
Lamon

(10) Patent No.: US 8,790,001 B2
(45) Date of Patent: Jul. 29, 2014

(54) METHOD FOR RESERVOIR MIXING IN A MUNICIPAL WATER SUPPLY SYSTEM

(75) Inventor: Douglas Lamon, Burlington (CA)

(73) Assignee: Landmark Structures I, L.P., Fort Worth, TX (US)

( * ) Notice: Subject to any disclaimer, the term of this patent is extended or adjusted under 35 U.S.C. 154(b) by 101 days.

(21) Appl. No.: 13/351,394

(22) Filed: Jan. 17, 2012

(65) Prior Publication Data

US 2012/0111414 A1 May 10, 2012

Related U.S. Application Data

(62) Division of application No. 11/382,110, filed on May 8, 2006, now Pat. No. 8,118,477.

(51) Int. Cl.
*B01F 5/02* (2006.01)

(52) U.S. Cl.
USPC ..... 366/173.2; 366/167.1

(58) Field of Classification Search
USPC ..... 366/167.1, 168.2, 172.1, 173.1, 173.2, 366/136–137, 165.1–165.5, 174.1, 175.2
See application file for complete search history.

(56) References Cited

U.S. PATENT DOCUMENTS

| | | | |
|---|---|---|---|
| 531,304 | A | 12/1894 | Dousman |
| 626,950 | A | 6/1899 | Wheelwright |
| 926,144 | A | 6/1909 | Sherow |
| 981,098 | A | 1/1911 | McCaskell |
| 1,000,689 | A | 8/1911 | Paterson |
| 1,026,578 | A | 5/1912 | Hammond |
| 1,054,629 | A | 2/1913 | Warwick |
| 1,135,080 | A | 4/1915 | Vandercook |
| 1,156,946 | A | 10/1915 | Vandercook |
| 1,192,478 | A | 7/1916 | Vandercook |
| 1,382,992 | A | 6/1921 | Lombard |
| 1,438,733 | A | 12/1922 | Werner |
| 1,445,427 | A | 2/1923 | Werner |
| 1,468,226 | A | 9/1923 | Colburn et al. |
| 1,468,887 | A | 9/1923 | Sterrick |
| 1,580,476 | A | 4/1926 | Fassio |
| 1,706,418 | A | 3/1929 | Sissom |
| 1,849,437 | A | 3/1932 | Rucker |
| 1,878,825 | A | 9/1932 | Caise |
| 1,961,548 | A | 6/1934 | Caise |
| 1,992,261 | A | 2/1935 | Traudt |
| 2,013,370 | A | 9/1935 | Tygart |
| 2,045,164 | A | 6/1936 | Richards |
| RE20,488 | E | 8/1937 | Zinkil |
| 2,192,806 | A | 3/1940 | Smith |
| 2,437,694 | A | 3/1948 | Hickman |
| 2,516,884 | A | 8/1950 | Kyame |
| 2,577,797 | A | 12/1951 | Moyer |
| 2,582,198 | A | 1/1952 | Etheridge |

(Continued)

FOREIGN PATENT DOCUMENTS

JP 2013-85978 A * 5/2013

*Primary Examiner* — Charles Cooley
(74) *Attorney, Agent, or Firm* — Hodgson Russ LLP

(57) ABSTRACT

One or more turbulent jet flows of fluid are discharged from inlet nozzles communicating with an inlet pipe to mix fluid in a reservoir, such as a water storage tank. The turbulent jet flows are directed to reach the surface of the fluid already existing in the reservoir. A horizontally disposed outlet section includes low loss contraction nozzles distributed throughout a lower portion of the reservoir to induce draining from all areas of the lower portion.

8 Claims, 14 Drawing Sheets

(56) References Cited

U.S. PATENT DOCUMENTS

| | | | | |
|---|---|---|---|---|
| 2,588,677 | A | 3/1952 | Welty et al. | |
| 2,592,904 | A | 4/1952 | Jackson | |
| 2,603,460 | A | 7/1952 | Kalinske | |
| 2,692,798 | A | 10/1954 | Hicks | |
| 2,900,176 | A | 8/1959 | Krogel | |
| 2,997,373 | A | 8/1961 | Stephens | |
| 3,202,281 | A | 8/1965 | Weston | |
| 3,292,861 | A | 12/1966 | Kawamura et al. | |
| 3,375,942 | A | 4/1968 | Boram | |
| 3,386,182 | A | 6/1968 | Lippert | |
| 3,586,294 | A | 6/1971 | Strong | |
| 3,647,188 | A | 3/1972 | Solt | |
| 3,648,985 | A | 3/1972 | Matweecha | |
| 3,661,364 | A | 5/1972 | Lage | |
| 3,692,283 | A | 9/1972 | Sauer et al. | |
| 3,718,319 | A | 2/1973 | Weisman | |
| 3,762,170 | A | 10/1973 | Fitzhugh | |
| 3,799,508 | A | 3/1974 | Arnold et al. | |
| 3,810,604 | A | 5/1974 | Reiter | |
| 3,846,079 | A | 11/1974 | Alagy et al. | |
| 3,847,375 | A | 11/1974 | Kuerten et al. | |
| 3,871,272 | A | 3/1975 | Melandri | |
| 4,100,614 | A | 7/1978 | Mandt | |
| 4,164,541 | A | 8/1979 | Platz et al. | |
| 4,187,029 | A | 2/1980 | Canale et al. | |
| 4,312,167 | A | 1/1982 | Cazaly et al. | |
| 4,325,642 | A * | 4/1982 | Kratky et al. | 366/137 |
| 4,327,531 | A | 5/1982 | Cazaly et al. | |
| 4,332,484 | A * | 6/1982 | Peters | 366/137 |
| 4,367,048 | A | 1/1983 | Morita | |
| 4,465,020 | A | 8/1984 | Schafer | |
| 4,491,414 | A | 1/1985 | Hayatdavoudi et al. | |
| 4,534,655 | A | 8/1985 | King et al. | |
| 4,578,921 | A | 4/1986 | Cazaly et al. | |
| 4,586,825 | A | 5/1986 | Hayatdavoudi | |
| 4,660,336 | A | 4/1987 | Cazaly et al. | |
| 4,660,988 | A | 4/1987 | Hara et al. | |
| 4,716,917 | A | 1/1988 | Schmidt | |
| 4,812,045 | A | 3/1989 | Rivers | |
| 4,886,446 | A | 12/1989 | Courrege | |
| 4,945,933 | A | 8/1990 | Krajicek et al. | |
| 5,048,598 | A | 9/1991 | Takemae et al. | |
| 5,061,080 | A | 10/1991 | MacKay et al. | |
| 5,078,799 | A | 1/1992 | Matter et al. | |
| 5,283,990 | A | 2/1994 | Shank, Jr. | |
| 5,300,232 | A | 4/1994 | Barrington et al. | |
| 5,332,312 | A | 7/1994 | Evanson | |
| 5,456,533 | A | 10/1995 | Streiff et al. | |
| 5,458,414 | A | 10/1995 | Crump et al. | |
| 5,558,434 | A | 9/1996 | Hamada et al. | |
| 5,564,825 | A | 10/1996 | Burt | |
| 5,606,995 | A | 3/1997 | Raftis | |
| 5,609,417 | A | 3/1997 | Otte | |
| 5,658,076 | A | 8/1997 | Crump et al. | |
| 5,735,600 | A * | 4/1998 | Wyness et al. | 366/101 |
| 5,769,536 | A | 6/1998 | Kotylak | |
| 5,810,473 | A | 9/1998 | Manabe et al. | |
| 5,863,119 | A | 1/1999 | Yergovich et al. | |
| 5,899,560 | A | 5/1999 | Byers | |
| 6,016,839 | A | 1/2000 | Raftis et al. | |
| 6,065,860 | A | 5/2000 | Fuchsbichler | |
| 6,109,778 | A | 8/2000 | Wilmer | |
| 6,186,657 | B1 | 2/2001 | Fuchsbichler | |
| 6,217,207 | B1 | 4/2001 | Streich et al. | |
| 6,237,629 | B1 * | 5/2001 | Zelch | 137/592 |
| 6,464,210 | B1 | 10/2002 | Teran et al. | |
| 6,481,885 | B2 | 11/2002 | Dupre | |
| 6,488,402 | B1 | 12/2002 | King et al. | |
| 6,536,468 | B1 * | 3/2003 | Wilmer et al. | 137/544 |
| 6,818,124 | B1 | 11/2004 | Simmons | |
| 6,821,011 | B1 | 11/2004 | Crump | |
| 6,854,874 | B2 | 2/2005 | Graham, Sr. | |
| 7,025,492 | B2 | 4/2006 | Dorsch et al. | |
| 7,059,759 | B2 | 6/2006 | Hummer | |
| 7,125,162 | B2 | 10/2006 | Graham, Sr. | |
| 7,229,207 | B2 | 6/2007 | Graham, Sr. | |
| 7,252,429 | B2 | 8/2007 | Yungblut | |
| 7,309,155 | B2 | 12/2007 | Sarrouh et al. | |
| 7,517,460 | B2 | 4/2009 | Tormaschy et al. | |
| 7,748,650 | B1 | 7/2010 | Sloan | |
| 7,748,891 | B2 * | 7/2010 | Tysse et al. | 366/174.1 |
| 7,862,225 | B2 | 1/2011 | Betchan et al. | |
| 8,118,477 | B2 * | 2/2012 | Lamon | 366/173.2 |
| 8,157,432 | B2 * | 4/2012 | Tysse et al. | 366/101 |
| 8,162,531 | B2 * | 4/2012 | Crump | 366/137 |
| 8,287,178 | B2 * | 10/2012 | Lamon | 366/173.2 |
| 8,292,194 | B2 * | 10/2012 | Blechschmitt et al. | 239/8 |
| 8,579,495 | B2 * | 11/2013 | Blechschmitt et al. | 366/101 |
| 2001/0038572 | A1 | 11/2001 | Dupre | |
| 2002/0105855 | A1 | 8/2002 | Behnke et al. | |
| 2003/0205277 | A1 * | 11/2003 | Raftis et al. | 137/592 |
| 2003/0210606 | A1 | 11/2003 | Chase et al. | |
| 2004/0081015 | A1 | 4/2004 | Graham, Sr. | |
| 2005/0111297 | A1 | 5/2005 | Sarrouh et al. | |
| 2005/0162972 | A1 | 7/2005 | Dorsch et al. | |
| 2005/0281131 | A1 | 12/2005 | Yungblut | |
| 2006/0245295 | A1 | 11/2006 | Dorsch et al. | |
| 2006/0291326 | A1 | 12/2006 | Crump | |
| 2007/0258318 | A1 | 11/2007 | Lamon | |
| 2008/0073444 | A1 * | 3/2008 | Blechschmitt et al. | 239/589 |
| 2008/0074944 | A1 * | 3/2008 | Blechschmitt et al. | 366/101 |
| 2008/0130404 | A1 | 6/2008 | Sarrouh et al. | |
| 2008/0151684 | A1 | 6/2008 | Lamon | |
| 2010/0232254 | A1 * | 9/2010 | Tysse et al. | 366/101 |
| 2014/0064017 | A1 * | 3/2014 | Blechschmitt et al. | |

* cited by examiner

METHOD FOR RESERVOIR MIXING IN A MUNICIPAL WATER SUPPLY SYSTEM

FIELD OF THE INVENTION

The present invention relates to liquid storage tanks that are in ground, above ground or elevated, hereinafter generically referred to as "reservoirs" and more particularly relates to methods and apparatus for the mixing of fluids in reservoirs and thereby preventing "stagnation" (as hereinafter defined) of fluids in reservoirs, excessive "aging" (as hereinafter defined) of fluids in reservoirs and/or the formation of an "ice cap" (as hereinafter defined). The present specification uses potable water as an example. However, the invention is equally applicable to other types of fluids where mixing is either required or desirable.

BACKGROUND OF THE INVENTION

Potable water reservoirs such as standpipes (normally tanks with height greater than diameter), ground storage tanks (normally tanks with height less than diameter) or elevated tanks are connected to water distribution systems and are used, among other things, to supply water to the systems and/or maintain the pressure in the systems during periods when water consumption from the system is higher than the supply mechanism to the system can provide. The reservoirs are therefore usually filling during periods when the system has supply capacity that exceeds the current consumption demand on the system or discharging into the system when the system has supply capacity that is less than the current consumption demand on the system. Potable water reservoirs typically contain water which has been treated through the addition of a disinfectant to prevent microbial growth in the water. Disinfectant concentrations in stored water decrease over time at a rate dependant upon a number of factors. This can result in unacceptable water quality if the period of retention of the water, or any part thereof in the reservoir, becomes too long or if the incoming fresh, treated water is not properly mixed with the existing stored water. Therefore, the age or retention period of water within potable water reservoirs and the mixing of incoming fresh water with the existing water are of concern to ensure that the quality of the water will meet the regulatory requirements for disinfectant concentrations. In addition, during periods of below freezing weather, the top surface of the water will cool and may freeze (this is referred to as an ice cap) unless it is exchanged for or mixed with the warmer water entering the reservoir. An ice cap may become thick enough to adhere to the reservoir walls and span the entire surface even when the water is drained from below. If sufficient water is drained from below a fully spanning ice cap, a vacuum is created, collapsing the ice cap which in turn can create, during the collapse, a second vacuum which can be much larger than the reservoir venting capacity and can result in an implosion of the roof and possibly the upper walls of the reservoir.

Water reservoirs are often filled and drained from a single pipe or a plurality of pipes located at or near the bottom of the reservoir. Under these conditions, when fresh water is added to the reservoir, it enters the lower part of the reservoir and when there is demand for water in the system, it is removed from the lower part of the reservoir resulting in a tendency for the last water added to be the first to be removed. This can be referred to as short circuiting. Temperature differences between stored water and new water may cause stratification which can in turn exacerbate short circuiting and water aging problems. Filling and draining from a single or a plurality of pipes located at or near the bottom creates little turbulence particularly in areas within the reservoir remote from these inlet and outlet pipes. As a result, the age or residency time of some waters within parts of the reservoir can be very long, resulting in loss of disinfectant residual, increase in disinfection by-products, biological growth, nitrification and other water quality and/or regulatory issues. This is referred to herein as "stagnation" or "stagnant water". A perfect system would provide a first in, last out scenario ("cycling"), however, perfect cycling is either not possible or is cost prohibitive. A preferred system provides a tendency toward cycling combined with a first mixing of the new water with existing tank contents that are most remote from the point of withdrawal. A preferred system would efficiently mix new water entering the tank with the existing tank contents thereby preventing stagnation. A preferred system would reduce the water age or residency time and related problems. A preferred system would eliminate the potential for ice cap formation.

The prior art recognizes the use of a plurality of inlet and outlet pipes, remote from each other in an attempt to promote mixing. Systems that have been proposed to date are typically ineffective or inefficient in that the water is not introduced properly and tends to short circuit or flow directly from the inlet to the outlet thus being unable to eliminate zones of stagnant water ("dead zones") that occur in the reservoir. The prior art also recognizes attempts to improve the performance of the preceding by the addition of a directional elbow and a reducer on the inlet but this method, utilizing a reducer only does not provide a developed jet flow and further does not provide orientation, number and diameter of inlet pipes that are selected for best possible mixing for a specific tank geometry.

It is desirable to provide an inexpensive and easily maintained mixing system for use in reservoirs in order to reduce the potential for stagnation and excessive aging of the contained fluids and further to reduce the potential for the formation of dangerous ice caps.

SUMMARY OF THE INVENTION

The present invention is a method of filling a reservoir, which includes:

a) filling the reservoir through one or a plurality of inlet nozzles which are designed to have a length, diameter, reduction and location to produce a developed turbulent jet flow which, when the inlet nozzle is positioned at the appropriate elevation and oriented in the appropriate direction(s) will direct said developed turbulent jet flow with the appropriate velocity to reach the surface of the liquid with initial mixing taking place in this area. The requisite design of the inlet nozzle(s) can be based on CFD (computational fluid dynamics) analysis using the actual tank geometry, minimum, maximum and average fill rates and actual operating parameters or on a similar equivalent analysis.

The present invention is a method of draining a reservoir, which includes:

b) draining fluid from the bottom of the reservoir utilizing a horizontally oriented outlet header and a plurality of inlet pipes terminating in low loss contraction nozzles designed to induce drainage across the entire lower area of the tank. The requisite design of the drain header, inlet pipes and low loss contraction nozzles can be based on CFD analysis using the actual tank geometry and minimum, maximum and average drainage rates or on a similar equivalent analysis.

BRIEF DESCRIPTION OF THE DRAWINGS

The present invention will be described by way of example only with reference to the following drawings.

DETAILED DESCRIPTION OF THE PREFERRED EMBODIMENT

Figure 1:
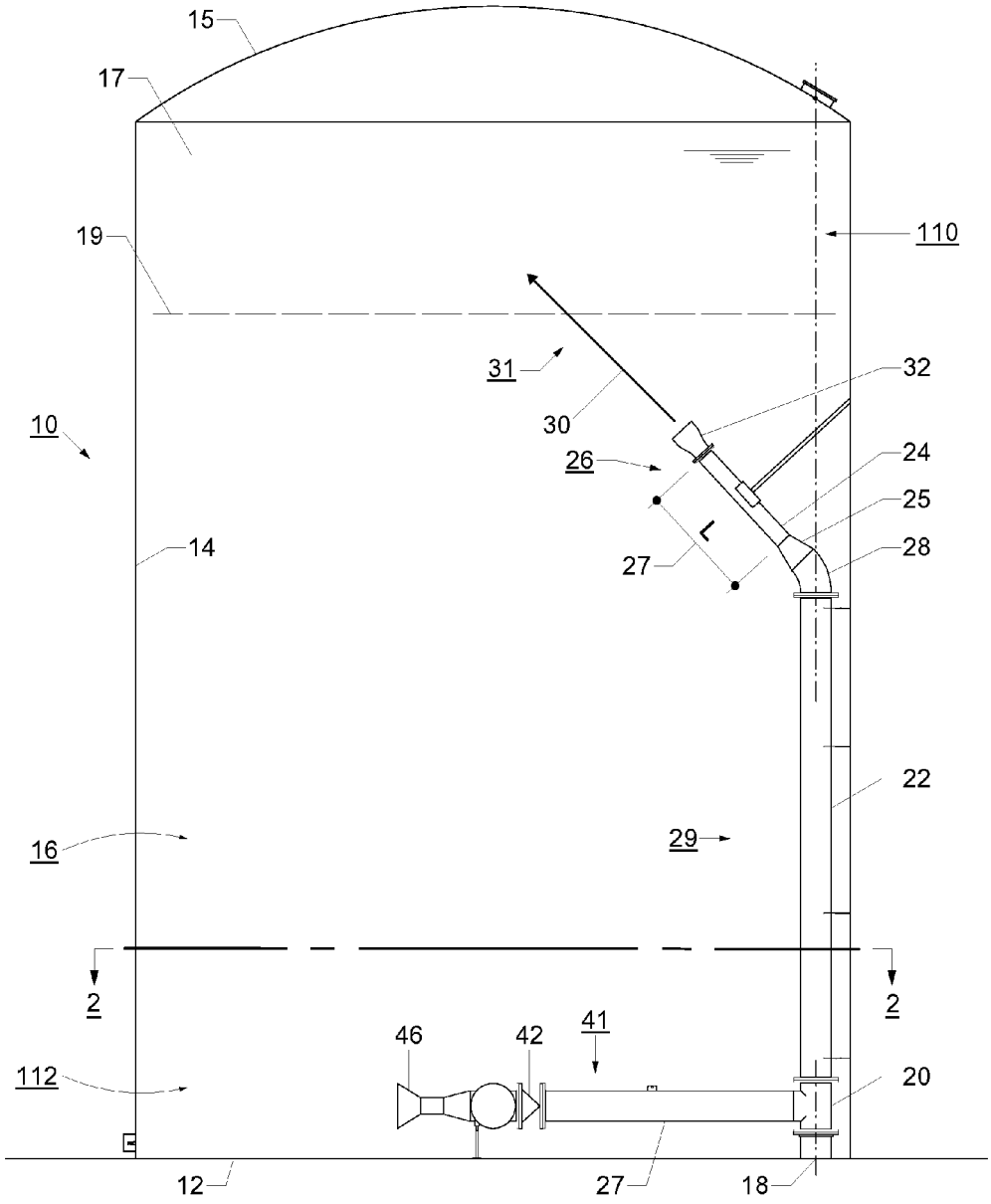
FIG. 1 is an elevation view of a reservoir mixing system in accordance with the present invention utilizing a single inlet/outlet pipe located by way of example only in a standpipe or ground type of storage tank or reservoir.

Referring now to FIGS. 1 through 4 by way of example only, the present invention, a method and apparatus for promoting mixing and thus eliminating stagnation and ice cap formation in fluid reservoirs, includes the following major components; storage reservoir 10, which is shown cylindrical in plan having a bottom 12 and top 15, together with side walls 14. Reservoir 10 includes an upper portion 110 which is the volume between the high water level 17 and the low water level 19 and is generally referred to as the "operating range", and a lower portion 112 which is the volume below the low water level 19. Reservoirs usually adopt the depicted cylindrical geometry, however, the invention is equally applicable to any tank or other type of fluid containing structure or vessel, of any cross section, in or above ground or elevated, with or without a roof or with a floating roof.

The storage reservoir of this invention is depicted by way of example only as storage reservoir 10 storing potable drinking water 16 having a high water level 17 which varies substantially under normal operating conditions to low operating water level 19.

The purpose of the present method and apparatus for promoting mixing and therefore eliminating stagnation and ice cap formation in fluid reservoirs is to add and withdraw water at different locations by a method which causes the mixing of the water in the reservoir and thereby prevents the existence of stagnant water regions in the tank without the use of auxiliary mechanical devices.

The present apparatus will be described in two separate sections shown generally as inlet section 29 and outlet section 41. Referring first to FIG. 1, and depicted by way of example only, common to both outlet section 41 and inlet section 29 is a inlet/outlet pipe 18 which is used to both feed and draw water into and out of reservoir 10. Inlet section 29 is connected to outlet section 41 at tee connection 20 as shown in FIG. 1.

Figure 3:
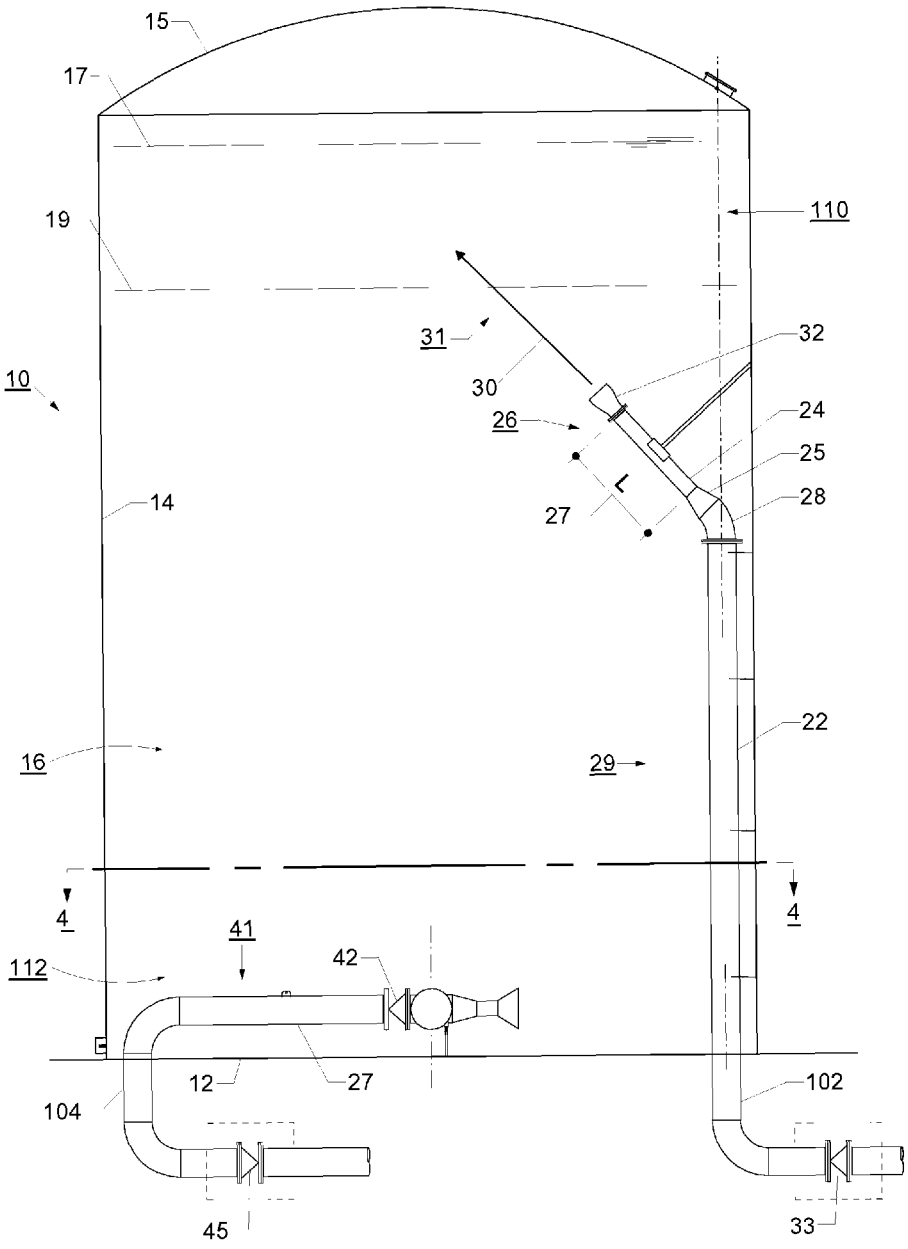
FIG. 3 is an elevation view of a reservoir mixing system in accordance with the present invention utilizing separate inlet and outlet pipes located by way of example only in a standpipe or ground type of storage tank or reservoir.

Referring to FIG. 3, and depicted by way of example only, outlet section 41 and inlet section 29 are shown having two separate pipes 102 and 104 entering and exiting the reservoir 10. Outlet section 41 and inlet section 29 may or may not be joined at a remote location. Inlet/outlet pipe 18 in FIG. 1, inlet pipe 102 in FIG. 3 and outlet pipe 104 in FIG. 3 are shown entering reservoir 10 as vertical pipes located adjacent to wall 14 but can enter in a horizontal or inclined position at any location.

Common to both systems depicted in FIGS. 1 and 3, inlet section 29 includes an inlet pipe 22 connected to an inlet nozzle 26. Inlet nozzle 26 includes a check valve 32, reducer 25, directional elbow 28 and nozzle pipe 24. Inlet nozzle 26 discharges incoming fresh water 30 in the form of a developed turbulent jet flow having a direction 31 relative to storage reservoir 10. Check valve 32 is shown as a duckbill check valve but can be any type of check valve mounted at the end of nozzle pipe 24 or inline at any point in inlet pipe 22 either within the reservoir or remote from the reservoir, as shown as an alternate in FIG. 3 as check valve 33 for a plurality of feed/draw pipes. Using inlet nozzle length L, the amount of reduction in reducer 25, and using the anticipated flow rate and water pressure entering feed pipe 22 when the reservoir is filling, an inlet nozzle 26 is designed which provides a developed turbulent jet flow along jet direction 31 as depicted in FIGS. 1 and 3 which has the appropriate velocity to reach the surface of the liquid.

Inlet Section 29

Fresh water entering reservoir 10 via inlet pipe 22 is directed to inlet nozzle 26. Water under pressure being injected through inlet nozzle 26 develops flow characteristics which direct the incoming fresh water 30 along jet direction 31 to the water surface which is typically, under operating conditions, between high water level 17 and low water level 19.

Inlet nozzle 26 is connected to inlet pipe 22 at a height above reservoir bottom 12 which ensures that the discharge end of inlet nozzle 26 is always below low water level 19 of reservoir 10, but sufficiently high that developed turbulent jet flow along jet direction 31 created by incoming fresh water 30 issuing from inlet nozzle 26 is capable of reaching the water surface at water level 17. Therefore, as the water level varies between low water level 19 and high water level 17, the jet created by incoming fresh water 30 will reach the surface of the water.

Outlet Section 41

Figure 2:
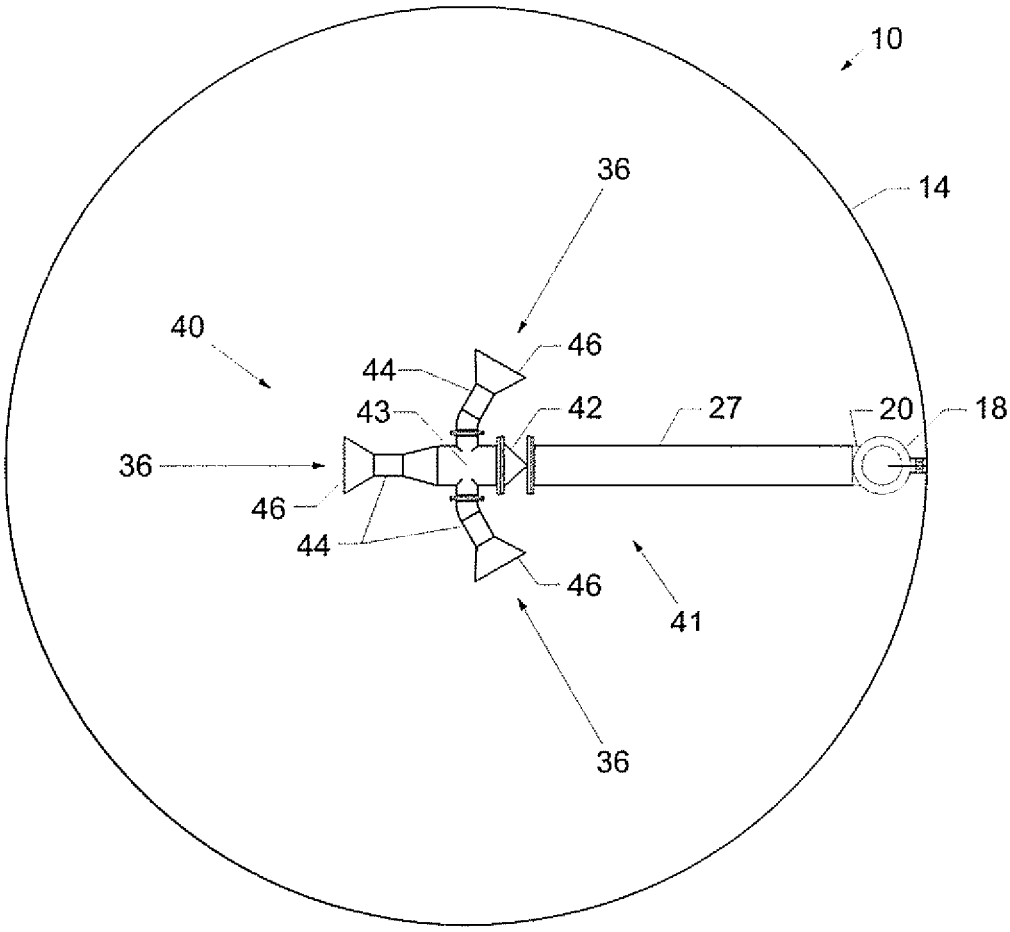
FIG. 2 is a sectional view of the lower part of the reservoir shown in FIG. 1, taken along line 2-2 of FIG. 1.

Referring now, by way of example only, to FIGS. 1 through 4 and more particularly to FIG. 2 showing the details of outlet section 41 which includes outlet pipe 27 connected by way of example only in FIG. 1 at tee connection 20 to inlet/outlet pipe 18.

Figure 4:
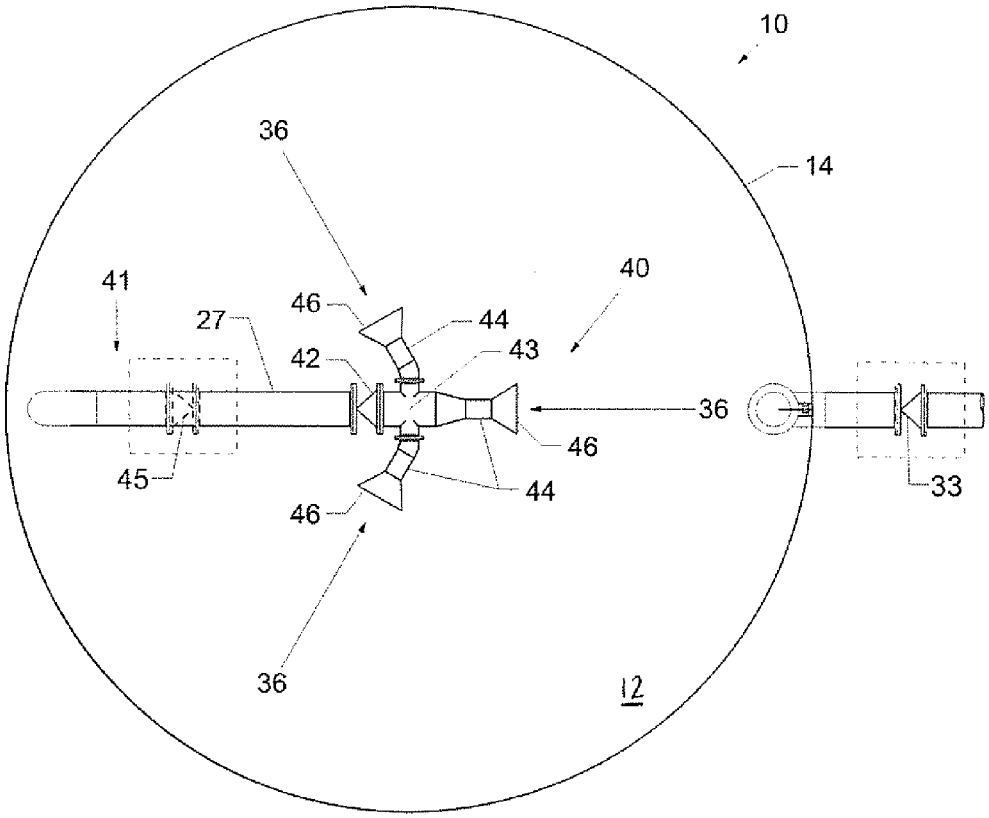
FIG. 4 is a sectional view of the lower part of the reservoir shown in FIG. 3, taken along line 4-4 of FIG. 3.

Referring to FIGS. 3 and 4, and depicted by way of example only, outlet section 41 and inlet section 29 are shown as two separate pipes namely, inlet pipe 102 and outlet pipe 104 exiting the reservoir which may or may not be joined at a remote location.

Common to both systems depicted in FIGS. 1 to 4, outlet section 41 further includes an outlet manifold shown generally as 40 which includes the following major components namely, a check valve 42 and horizontally oriented outlet tributary pipes 44 terminating at low loss contraction nozzles 46 and joined together at fitting 43. Fitting 43 is shown by way of example only as a cross type fitting but may be any type of fitting or a plurality of fittings depending on the number of horizontal outlet tributary pipes 44. The diameter and length of outlet tributary pipes 44 and the diameter and length of low loss contraction nozzles 46 are designed using the anticipated volume of water exiting outlet pipe 27 or 104 when the reservoir is draining to induce flow from all areas of the lower portion of the reservoir. Check valve 42 can be any type of check valve located anywhere in outlet pipe 27 or 104 and, while shown as a single inline valve in outlet pipe 27 or 104, could also be three individual valves in outlet tributary pipes 44 for example or it could be located as shown as 45 in FIG. 3.

The horizontal outlet tributary pipes 44 are shown as roughly equally spaced radial oriented pipes located in lower portion 12 of reservoir 10 such that fluid is drawn from all areas of the lower portion of the reservoir as shown by outgoing water flow arrows 36. The outlet manifold 40 and outlet tributary pipes 44 are shown by example as being centrally and radially located but can be located anywhere within the lower portion 112 of reservoir 10 as long as the configuration and length of outlet tributary pipes 44 induces flow from all areas of the lower portion of the reservoir.

Operation

A person skilled in the art will note that water is fed into the top portion 110 of the reservoir via a developed turbulent jet flow along jet direction 31 to encourage mixing first with the water most remote from the point of withdrawal.

A person skilled in the art will note that water is drawn from the entire lower portion 112 of the reservoir due to the orientation, sizing and configuration of horizontal outlet tributary pipes and the use and design of low loss contraction nozzles. The number and radial length of outlet tributary pipes depends upon the reservoir size and the location of outlet manifold 40.

A person skilled in the art will note that during times of reservoir filling, water is prevented from initially entering the lower portion 112 of the reservoir by check valve 42 and during times of withdrawal, water is prevented from leaving the top portion 110 of the reservoir by check valve(s) 32.

A person skilled in the art will note that incoming water which has a negative buoyancy, i.e., is colder than existing reservoir contents (a common hot weather or summer condition) will be directed first to the surface of the top portion 110 of the reservoir contents by a developed turbulent jet flow along jet direction 31 and will subsequently, due to negative buoyancy, migrate toward the lower portion 112 of the reservoir thus accelerating mixing first with the reservoir contents most remote from the point of withdrawal and subsequently with the entire reservoir contents. Furthermore, it will be recognized that this accelerated mixing is a desirable condition during warm weather when disinfectant concentrations decrease at the fastest rate.

A person skilled in the art will note that incoming water which has a positive buoyancy, i.e. is warmer than existing reservoir contents (a common cold weather or winter condition) will be directed first to the surface of the top portion 110 of the reservoir contents by a developed turbulent jet flow along jet direction 31 and will subsequently, due to positive buoyancy have less tendency to immediately migrate toward the lower portion 112 of the reservoir. Furthermore, it will be recognized that this is a desirable condition during cold weather since the extended residency of the warmer water in top portion 110 will ensure that a dangerous ice cap does not form.

A person skilled in the art will note that the required number and orientation of inlet nozzles will depend on factors which include but are not necessarily limited to the size or diameter of the reservoir and the rate of reservoir filling which affects the discharge velocity of the inlet nozzles. Furthermore, it will be realized that one or a plurality of inlet nozzles can be utilized without departure from the spirit of the invention. In addition, it will be realized that a plurality of inlet nozzle(s) locations within the reservoir can be utilized without departure from the spirit or scope of the invention.

A person skilled in the art will note that there may be reservoir configurations which necessitate a number of vertical locations of inlet nozzles. Furthermore, it will be realized that one or a plurality of vertical locations of inlet nozzles can be utilized without departure from the spirit or scope of the invention.

A person skilled in the art will note that the required number and orientation of outlet tributary pipes will depend on factors which include but are not necessarily limited to the size or diameter of the reservoir. Furthermore, it will be realized that one or a plurality of outlet tributary pipes can be utilized without departure from the spirit or scope of the invention.

A person, skilled in the art, will note that the use of low loss contraction nozzles will depend on factors which include but are not necessarily limited to the size or diameter of the reservoir or drainage area within the reservoir. Furthermore, it will be realized that low loss contraction nozzles can be deleted where appropriate without departure from the spirit of the invention.

It is therefore apparent to a person skilled in the art that a system has been created which consistently places the incoming, fresh, treated and (in winter) warmer water first at the top of reservoir 10 while forcing the withdrawal from the bottom.

It is therefore apparent to a person skilled in the art that a system has been created which provides maximum acceleration to the mixing of the incoming, fresh, treated water with existing tank contents during periods of negative buoyancy (summer) when this is most desirable.

It is therefore apparent to a person skilled in the art that a system has been created which reduces the potential for dangerous ice cap formation during periods of positive buoyancy (winter) when this is most desirable.

It should be apparent to a person skilled in the art that a preferred system has been created which combines mixing and the removal of potentially dangerous ice caps.

Figure 5:
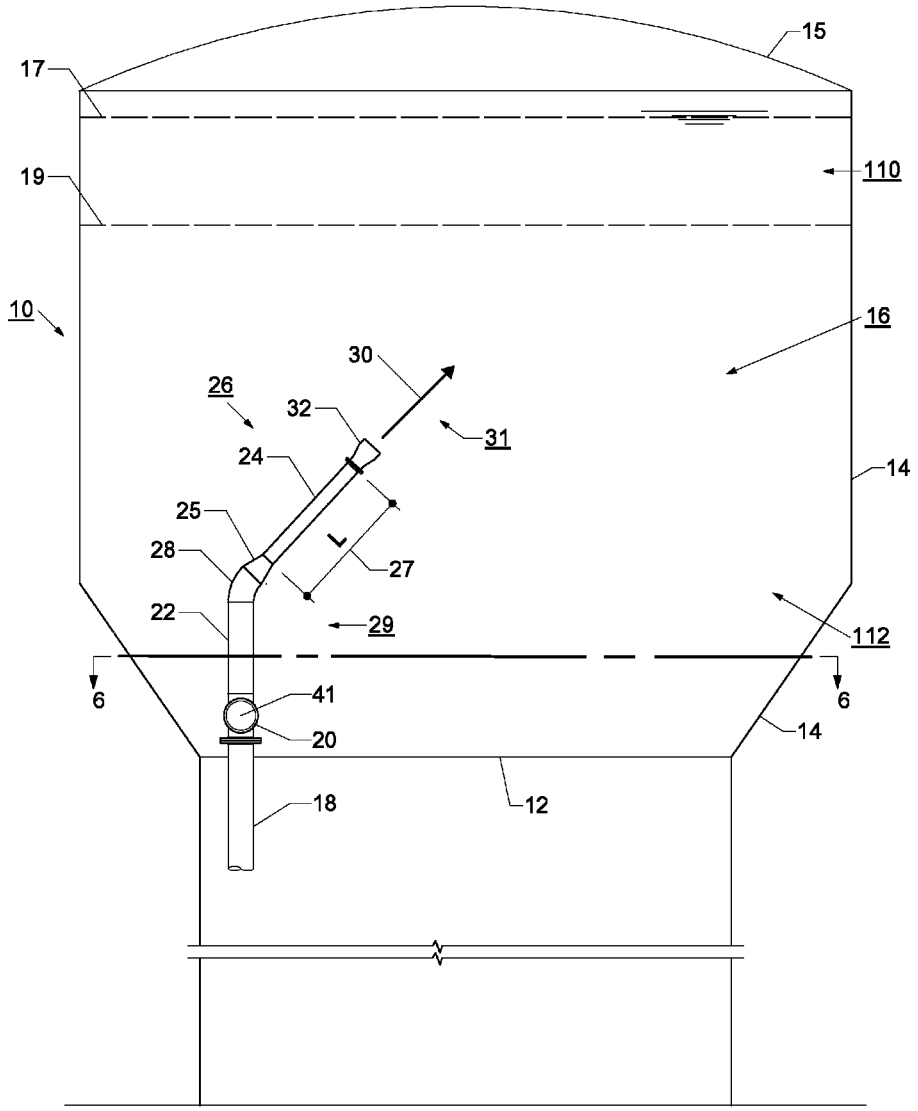
FIG. 5 is an elevation view of a reservoir mixing system in accordance with the present invention utilizing a single inlet/outlet pipe located by way of example only in an elevated type of storage tank or reservoir.
Figure 6:
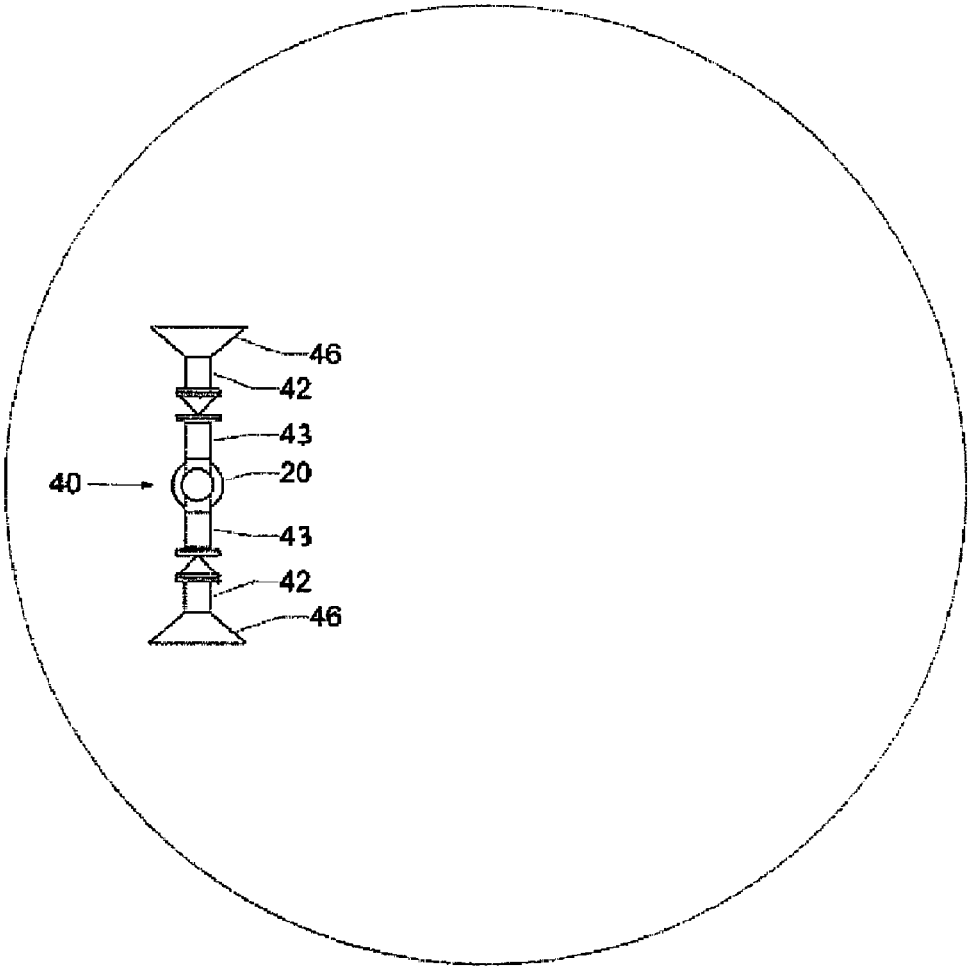
FIG. 6 is a sectional view of the lower part of the reservoir shown in FIG. 5, taken along line 6-6 of FIG. 5.

It should be apparent to persons skilled in the art that various other modifications and adaptations of the structure described above are possible without departure from the spirit or scope of the invention. Without limiting the generality of the foregoing, some of these modifications and adaptations are illustrated in FIGS. 5 to 14 and described herein as follows:

FIGS. 5 and 6 illustrate by way of example only the present invention as it would be used in an elevated storage tank or reservoir with a single inlet/outlet pipe.

Figure 7:
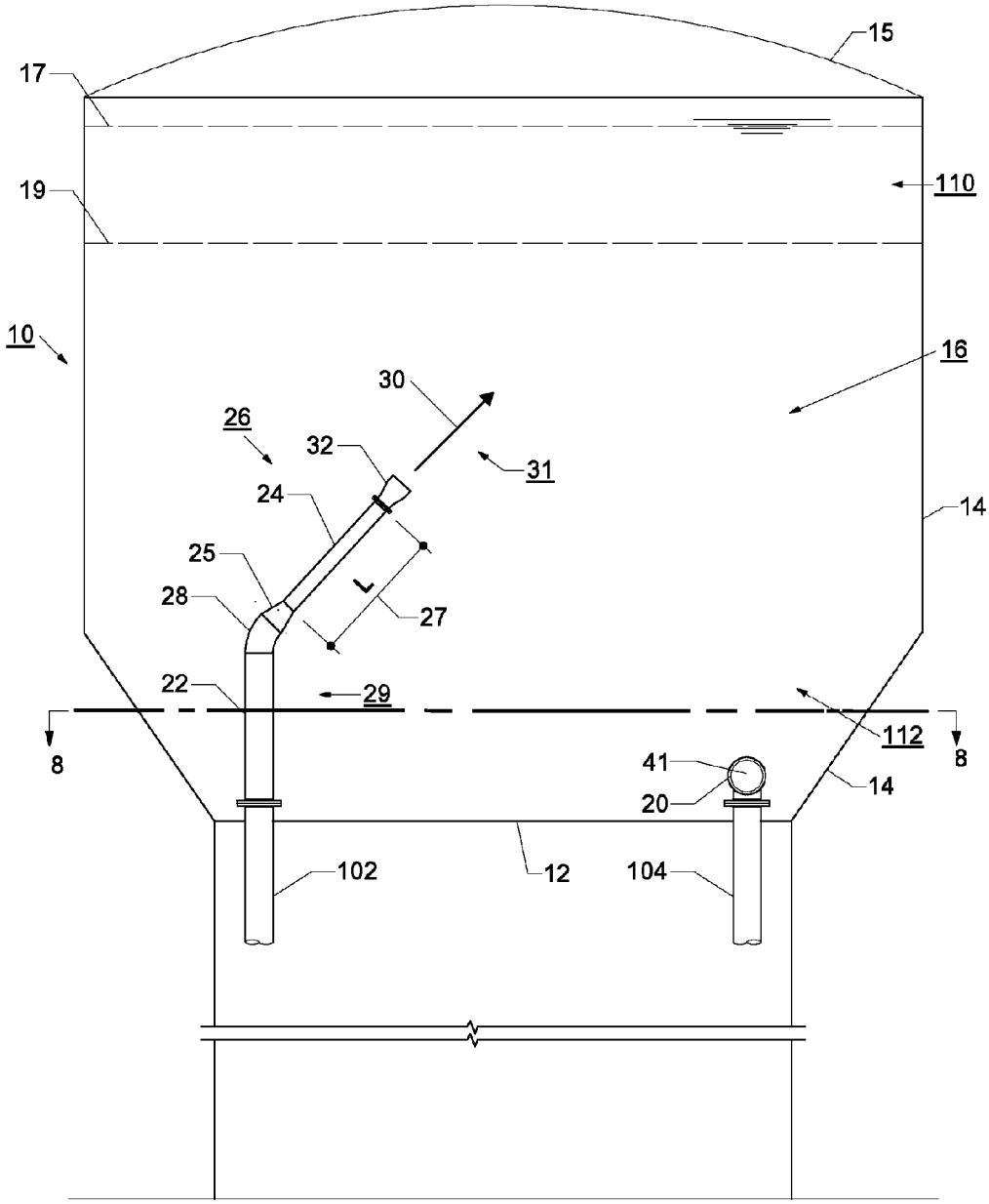
FIG. 7 is an elevation view of a reservoir mixing system in accordance with the present invention utilizing separate inlet and outlet pipes located by way of example only in an elevated type of storage tank or reservoir.
Figure 8:
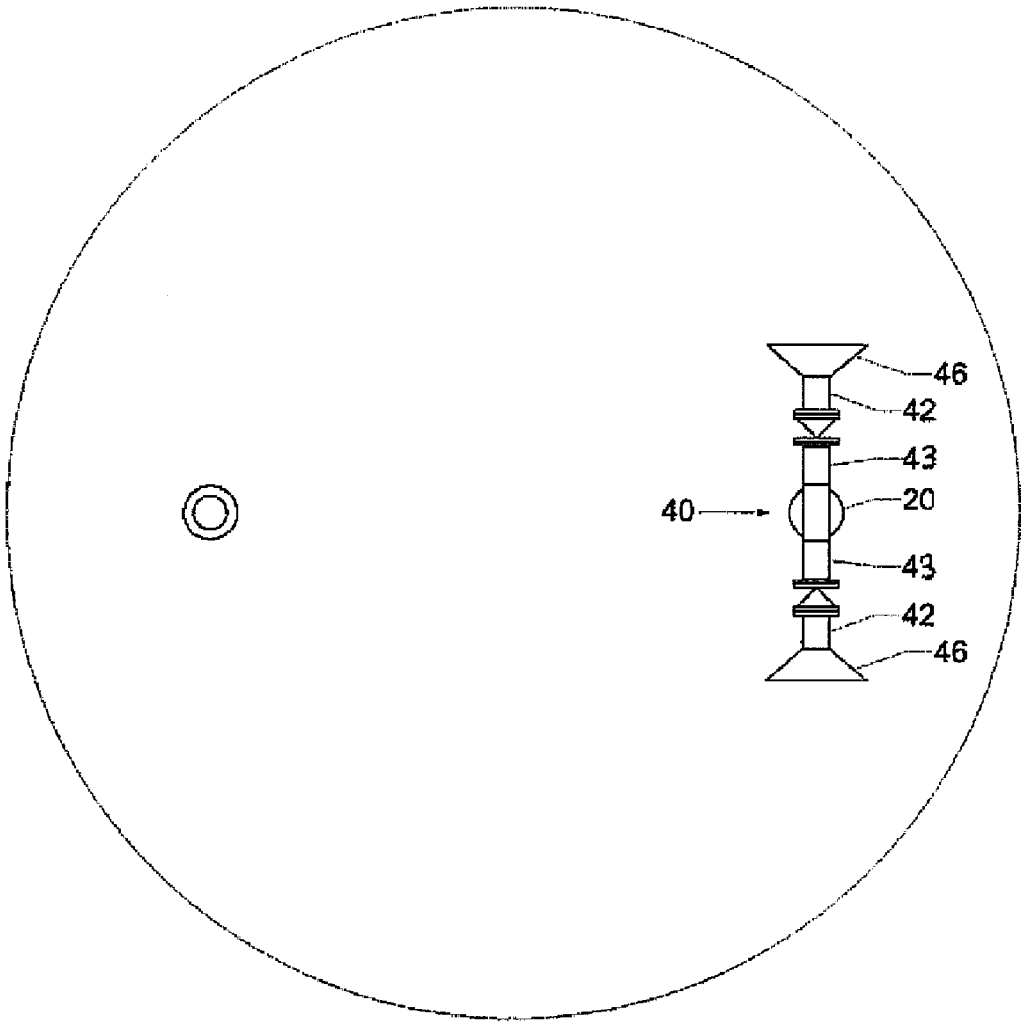
FIG. 8 is a sectional view of the lower part of the reservoir shown in FIG. 7, taken along line 8-8 of FIG. 7.

FIGS. 7 and 8 illustrate by way of example only the present invention as it would be used in an elevated storage tank or reservoir with separate inlet and outlet pipes.

Figure 9:
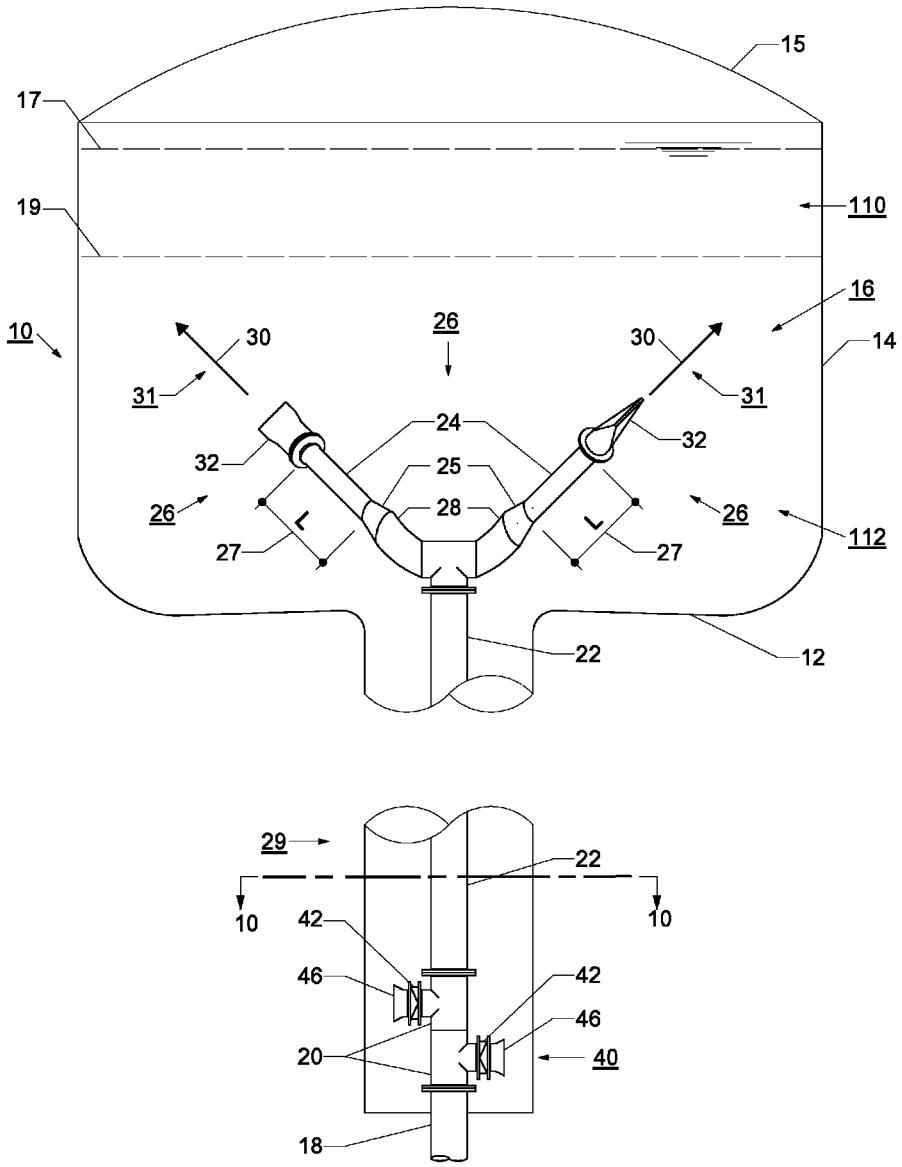
FIG. 9 is an elevation view of a reservoir mixing system in accordance with the present invention utilizing a single inlet/outlet pipe located by way of example only in an elevated type of storage tank or reservoir which incorporates an inlet/outlet line located in the bottom of an oversized inlet line which oversized inlet line is commonly referred to as a "wet riser'.
Figure 10:
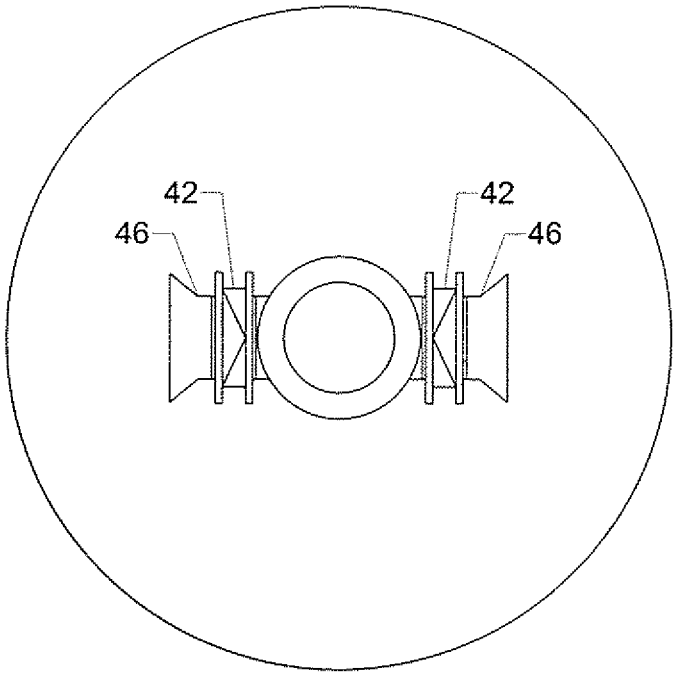
FIG. 10 is a sectional view of the lower part of the wet riser shown in FIG. 9, taken along line 10-10 of FIG. 9.
Figure 11A:
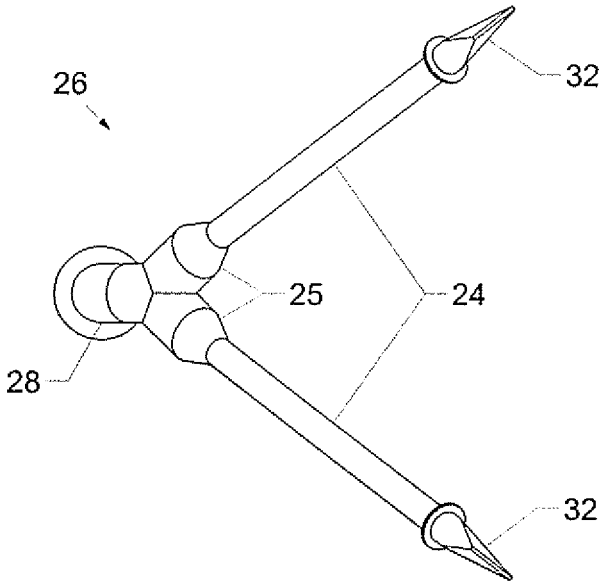
FIG. 11A is an elevation view of an alternate inlet nozzle arrangement.
Figure 11B:
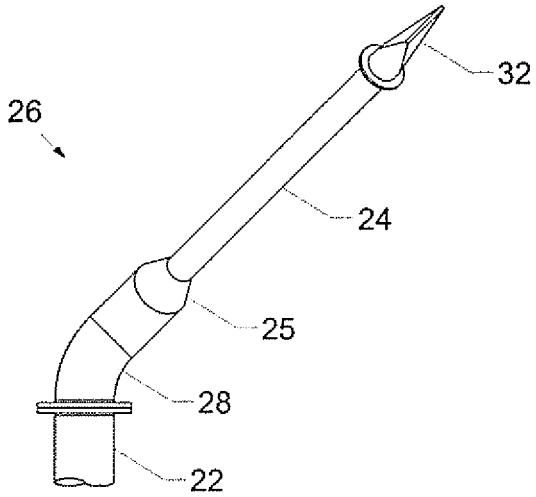
FIG. 11B is a plan view of an alternate inlet nozzle arrangement.
Figure 12A:
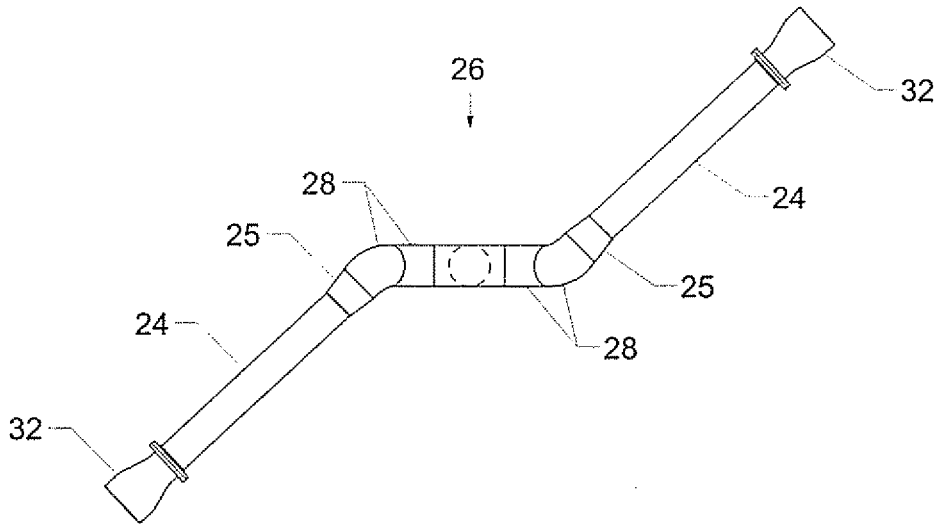
FIG. 12A is an elevation view of a second alternate inlet nozzle arrangement.
Figure 12B:
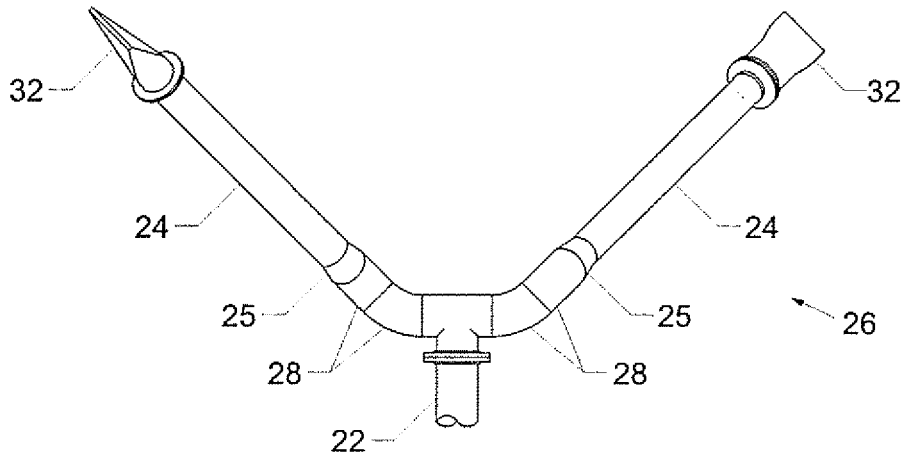
FIG. 12B is a plan view of a second alternate inlet nozzle arrangement.
Figure 13A:
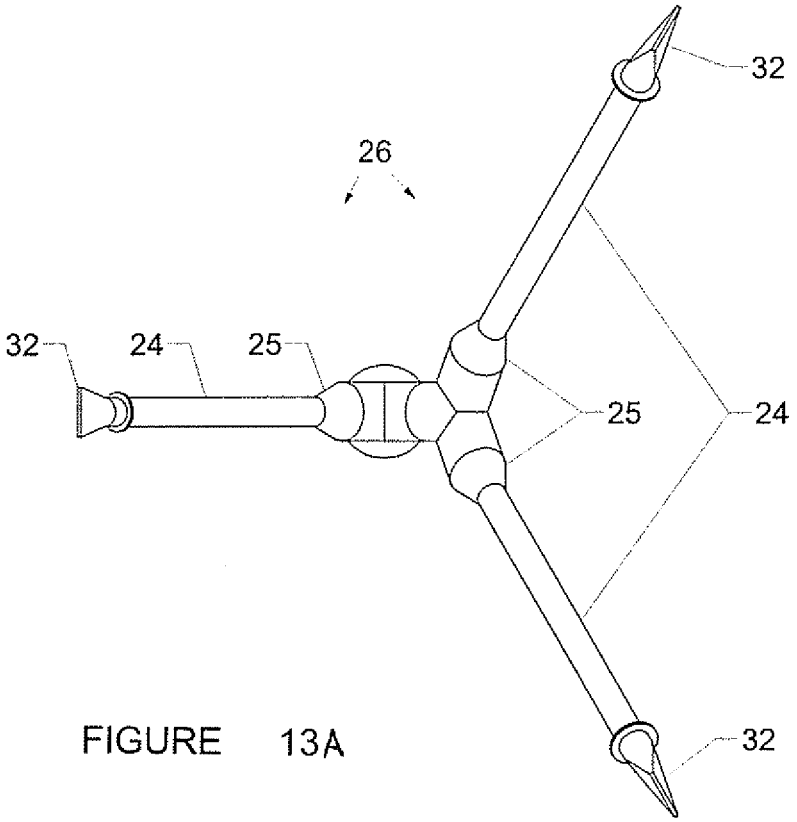
FIG. 13A is an elevation view of a third alternate inlet nozzle arrangement.
Figure 13B:
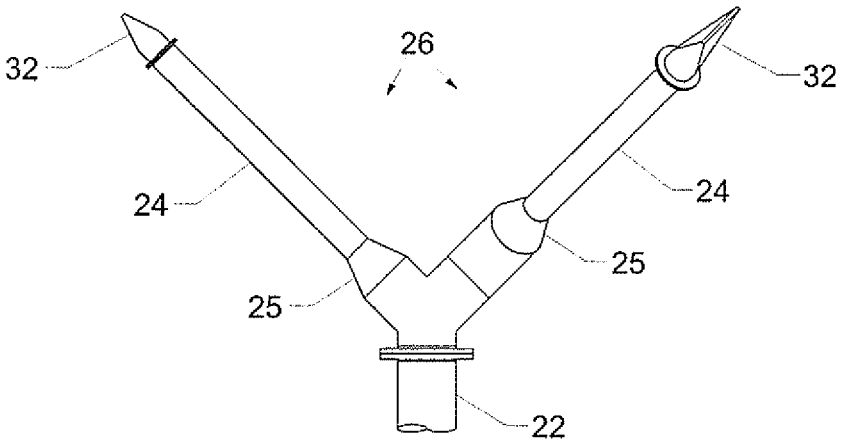
FIG. 13B is a plan view of a third alternate inlet nozzle arrangement.

FIGS. 9 and 10 illustrate by way of example only the present invention as it would be used in an elevated storage tank or reservoir with a wet riser.

FIGS. 11A, 11B, 12A, 12B, 13A and 13B illustrate by way of example only alternative inlet arrangements which incorporate a plurality of inlet nozzles and can be utilized without departure from the spirit of the invention.

Figure 14:
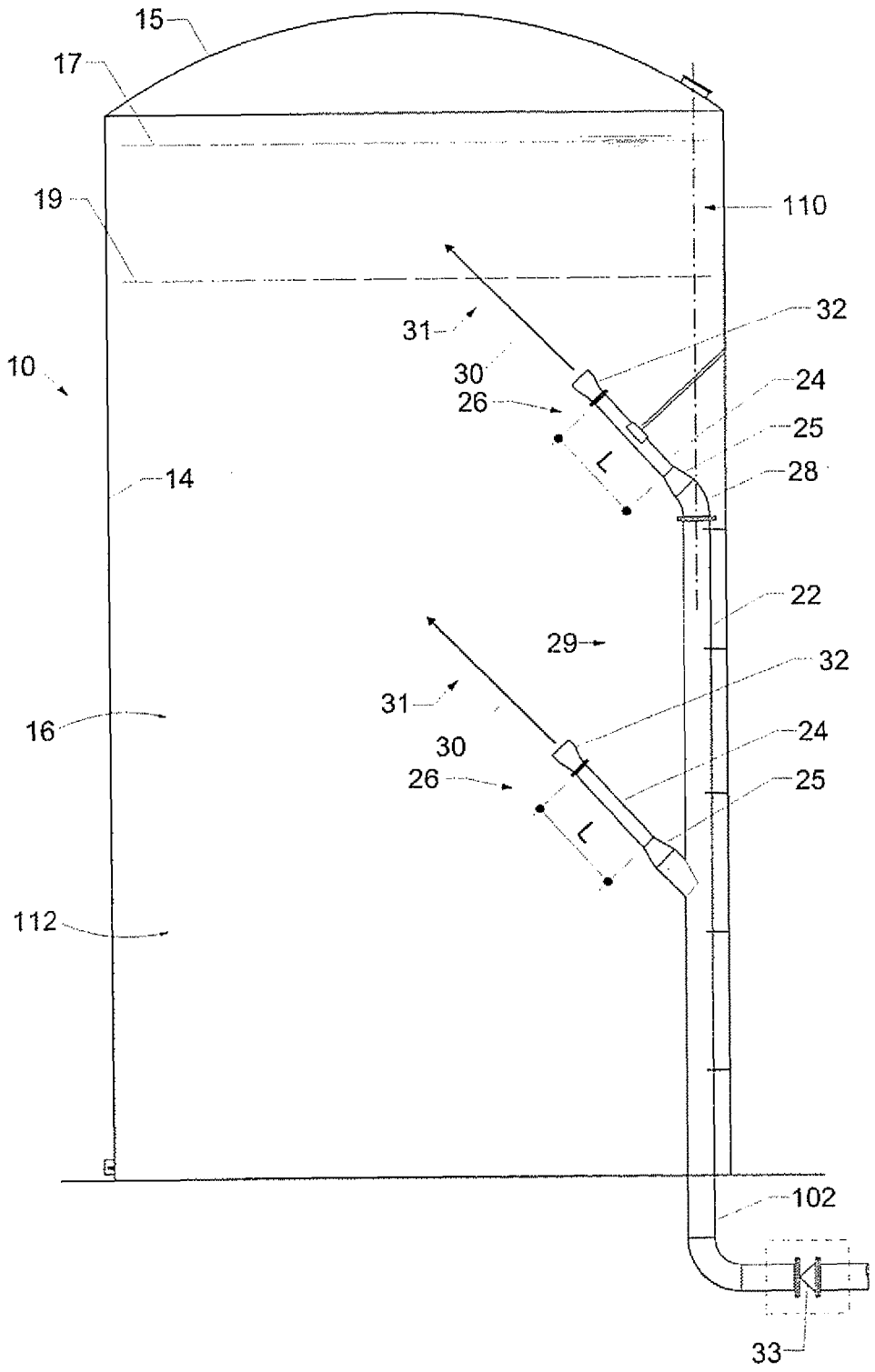
FIG. 14 is an elevation of an inlet nozzle arrangement showing a plurality of vertical inlet nozzle locations.

FIG. 14 illustrates by way of example only a plurality of vertical inlet arrangements which can be utilized without departure from the spirit or scope of the invention.

What is claimed is:

1. A method of mixing water in a municipal water supply reservoir, the reservoir holding a variable volume of water that varies between a low water level and a high water level as defined by a surface of the water, the method comprising the steps of:

positioning an inlet pipe and an inlet nozzle in the reservoir, the inlet nozzle communicating with the inlet pipe and being located below the low water level to be submerged in the water, wherein the inlet nozzle includes a reducer, an elongated nozzle pipe mounted to an exit end of the reducer, and a duckbill check valve mounted to an exit end of the nozzle pipe; and discharging a turbulent jet flow of water from the inlet nozzle into the reservoir, wherein the turbulent jet flow of fluid is directed upward toward the surface of the water and reaches the surface of the water in the reservoir.

2. The method of claim 1, wherein the step of positioning an inlet pipe and an inlet nozzle includes retrofitting an existing reservoir with the inlet pipe and the inlet nozzle.

3. The method of claim 1, wherein the step of positioning an inlet pipe and the inlet nozzle includes arranging the inlet pipe to extend in a vertical direction until the inlet pipe reaches the inlet nozzle, wherein the inlet nozzle is located nearer to the low water level than to a bottom wall of the reservoir.

4. The method of claim 1, wherein the step of positioning an inlet pipe and the inlet nozzle includes providing a plurality of inlet nozzles below the low water level, each of the plurality of inlet nozzles communicating with the inlet pipe, and wherein the step of discharging a turbulent jet flow of water includes discharging a plurality of turbulent jet flows of water each from a respective one of the plurality of inlet nozzles, each of the plurality of turbulent jet flows of water being directed upward toward the surface of the water and reaching the surface of the water in the reservoir at a unique location on the surface of the water.

5. The method of claim 1 further comprising the steps of:

positioning an outlet pipe and an outlet manifold in the reservoir below the surface of the water, the outlet manifold communicating with the reservoir and the outlet pipe and being located at an elevation lower than the elevation of the inlet nozzle; and draining water from the reservoir through the outlet manifold and the outlet pipe.

6. The method of claim 5 wherein the outlet manifold includes a horizontally oriented outlet tributary pipe having a low loss contraction nozzle.

7. The method of claim 6 wherein the outlet manifold includes a plurality of horizontally oriented outlet tributary pipes each having a respective low loss contraction nozzle, and the low loss contraction nozzles are located apart from one another to induce drainage throughout the lower portion of the reservoir.

8. The method of claim 5, wherein the outlet pipe differs from the inlet pipe.

* * * * *